United States Patent [19]

Ta

[11] Patent Number: 4,957,208

[45] Date of Patent: Sep. 18, 1990

[54] MULTIPLE CONTACT ELECTRICAL CONNECTOR PORTION FOR AN AUTOMATIC RAILWAY COUPLER

[75] Inventor: Cuong Manh Ta, Taylors, S.C.

[73] Assignee: American Standard Inc., Spartanburg, S.C.

[21] Appl. No.: 356,143

[22] Filed: May 24, 1989

[51] Int. Cl.[5] ..... B61G 5/06

[52] U.S. Cl. ..... 213/1.3; 439/359

[58] Field of Search ..... 213/1.3, 1.6; 439/359, 439/361, 362, 363

[56] References Cited

U.S. PATENT DOCUMENTS

| | | | |
|---|---|---|---|
| 2,742,626 | 4/1956 | Collins et al. | 439/363 |
| 3,249,239 | 5/1966 | Herbert et al. | 213/1.6 |
| 3,259,872 | 7/1966 | Kyle | 439/362 |
| 3,263,823 | 8/1966 | Gobrecht | 213/1.6 |
| 3,385,454 | 5/1968 | Jeffrey et al. | 213/1.3 |
| 3,406,371 | 10/1968 | Buckeridge | 439/363 |
| 3,438,511 | 4/1969 | Cope | 213/1.3 |
| 3,472,396 | 10/1969 | Frill | 213/1.3 |
| 3,499,545 | 3/1970 | Cope et al. | 213/1.3 |
| 3,506,139 | 4/1970 | Cope et al. | 213/1.3 |
| 3,552,580 | 1/1971 | Cope | 213/1.3 |
| 3,606,030 | 9/1971 | Frill et al. | 213/1.3 |
| 3,633,762 | 1/1972 | Gnavi | 213/1.3 |
| 3,773,186 | 11/1973 | Reno et al. | 213/1.3 |
| 3,842,987 | 10/1974 | Prada | 213/1.3 |
| 4,767,351 | 8/1988 | Patel et al. | 439/363 |

FOREIGN PATENT DOCUMENTS

| | | | |
|---|---|---|---|
| 1053553 | 3/1959 | Fed. Rep. of Germany | 213/1.6 |
| 2547959 | 12/1984 | France | 439/359 |
| 693414 | 7/1953 | United Kingdom | 439/359 |

*Primary Examiner*—Robert P. Olszewski
*Assistant Examiner*—Mark T. Le
*Attorney, Agent, or Firm*—J. B. Sotak

[57] ABSTRACT

An electrical connection portion for a railway car coupler having multiple contacts for being connected to train line circuits. The electrical connection portion includes a plurality of movable and stationary contact elements and a plurality of conductive studs assembled from the front side of an insulative block. There is a plurality of jumper plates electrically connected to selected ones of the conductive studs for establishing train line circuits.

20 Claims, 3 Drawing Sheets

FIG.5
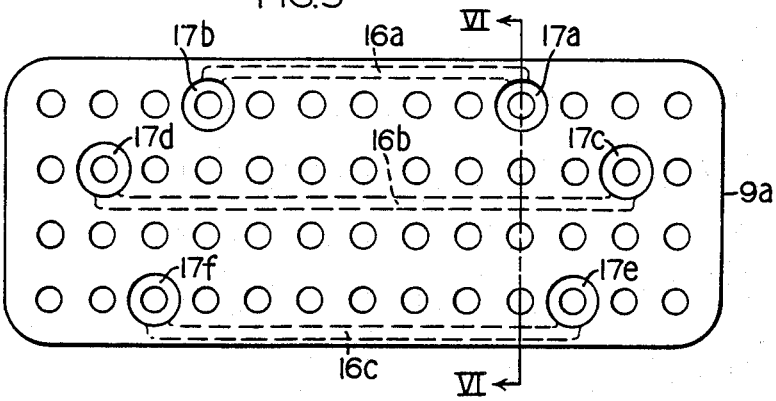
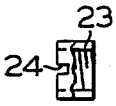
FIG.7
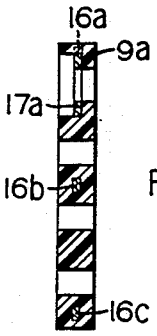
FIG.6
FIG.8
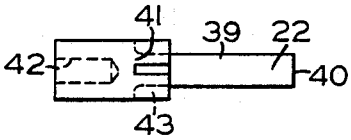
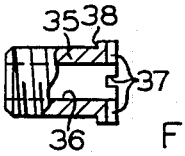
FIG.9
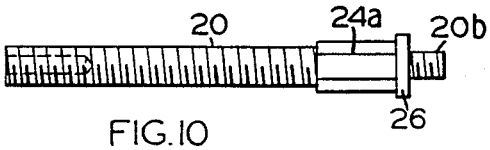
FIG.10
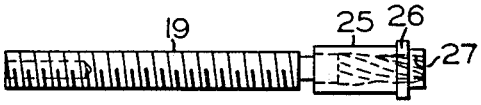
FIG.11
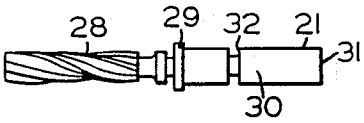
FIG.12

MULTIPLE CONTACT ELECTRICAL CONNECTOR PORTION FOR AN AUTOMATIC RAILWAY COUPLER

FIELD OF THE INVENTION

This invention relates to an automatic railway car coupling apparatus having an electrical connection portion including a slide frame assembly for accommodating a multiple contact unit having a front insulative block including a plurality of movable and stationary contacts disposed in rows and columns and having a rear insulative stack of circuit jumper plates having copper strips for interconnecting selected electrical studs which are electrically connected with the associated movable and stationary contacts.

BACKGROUND OF THE INVENTION

In certain mass and/or rapid transit systems, such as, in subway and light rail commuter operations, the passenger cars are equipped with automatic couplers which are not only mechanically interconnected to the cars of the train but also are electrically and pneumatically coupled to the electric and air train lines ordinarily carried by the coupler housing. In a previous type of car coupler, the electrical portion normally included a plurality of electrical contact elements for interconnecting the train line circuits. The electric portion of a former coupler includes a slide frame assembly having a front slide frame and a rear slide frame. The front slide frame normally includes a metal collar or cover encasing the front insulating block which contains a plurality of spring-biased electrical contacts. The electrical contacts are pre-loaded by being abutted by an adjustable double-hex nut arrangement. The rear slide frame also includes a metal housing or cover which contains a rear contact block and a cured epoxy resin compound encapsulating the plurality of contact-associated terminal elements and the interconnecting insulated jumper wires. The train line circuit leads are solder connected to openings formed in the free ends of the terminals.

It will be appreciated that the prior art arrangement has a number of shortcomings and associated disadvantages. For example, it is virtually impossible to repair or replace a damaged jumper wire which is encapsulated in the mass of the cured epoxy compound. Accordingly, it is necessary to remove and replace the entire or complete rear slide frame when damage occurs to one or more of the jumper wires. Further, the construction of the prior art rear slide frame is relatively expensive since it involves a long drawn out multi-step manufacturing process or procedure. First, the metal cover must be initially partially machined from a crude casting. After placement of the terminal elements and situation and connection of the jumper wires, the epoxy resin is poured into the metal cover and is allowed to cure for an appropriate period of time. After a curing time of sixteen (16) hours at 176° F., the final machining of the frame takes place. In addition, it has been found that the spring-biased electrical contacts are not removable from the exposed side of the front block, and that the whole front slide frame had to be removed before it is possible to replace the contacts. Further, it has been determined that during rainy weather and during car washing periods, water and cleaning solutions as well as dirt can seep through the clearance space between the contacts and the holes in the front block. This allows moisture to accumulate internally, which can cause corrosion of the contacts, the springs, and the double-hex nuts which can result in mechanical and electrical failure. Likewise, it has been found that the springs in the stationary electric contacts are susceptible to taking a permanent set when subject to high current surges.

OBJECTS AND SUMMARY OF THE INVENTION

Therefore, it is an object of this invention to provide a new and improved electrical connector portion for railway car couplers.

A further object of this invention is to provide an automatic railway coupler having an enhanced slide frame assembly including a plurality of movable and stationary electrical contacts carried by an insulative front block and including a plurality of associated terminal stud elements passing through a stack of rear jumper plates for establishing train line circuits.

Another object of this invention is to provide a unique slide frame assembly for an electrical contact portion of an automatic railway car coupler having an easy and flexible arrangement of interchanging the electrical jumper configuration as desired.

Still a further object of this invention is to provide an automatic car coupler having a unique multiple contact electrical connection portion including a rear slide frame which only requires a one-step machining operation.

Still another object of this invention is to provide a railway vehicle coupler having an electrical portion including an insulative front contact block in which movable and stationary contact elements may be quickly and easily removed and replaced from the front end of the contact block.

Yet a further object of this invention is to provide an electrical contact portion in which the stationary contacts are not adversely effected by high current surges.

Yet another object of this invention is to provide a multiple contact electrical connector portion for a railway car coupler which is simple in design, economical in cost, durable in use, efficient in service, and reliable in operation.

In accordance with the present invention, there is provided an electrical connector portion for an automatic railway car coupler comprising, a slide frame connectable to the electrical connector portion, a multiple contact unit carried by the slide frame, the multiple contact unit includes an outer insulative block having a plurality of aligned apertures for accommodating a plurality of movable and stationary contact elements and including an inner insulative block constructed of a plurality of stacked jumper plates, each of said jumper plates having a plurality of aligned holes for accommodating a plurality of conductive studs which are electrically connected to the respective movable and stationary contact elements and, in turn, which are electrically connected to selected train line conductors.

DESCRIPTION OF THE DRAWINGS

The above objects and other attendant features and advantages will be more readily appreciated as the present invention becomes better understood by reference to the following detailed description when considered in conjunction with the accompanying drawings, wherein:

FIG. 5 is a reduced front view of one of the plurality of jumper plates which make up the rear slide frame of the electrical portion of FIG. 1;

FIG. 6 is a cross-sectional view of the jumper plate taken along line VI—VI of FIG. 5;

FIG. 7 is a side elevational view, partly in section, of a jumper nut for mechanically and electrically interconnecting the studs and the jumper plates;

FIG. 8 is a side elevational view of a stationary contact element;

FIG. 9 is a side elevational view, partly in section, of a retaining nut for the stationary and movable contact elements;

FIG. 10 is a side elevational view of a threaded stud for the stationary contact element;

FIG. 11 is a side elevational view of a threaded stud for the movable contact element; and FIG. 12 is a side elevational view of a movable contact element.

DETAILED DESCRIPTION OF THE INVENTION

Figure 1:
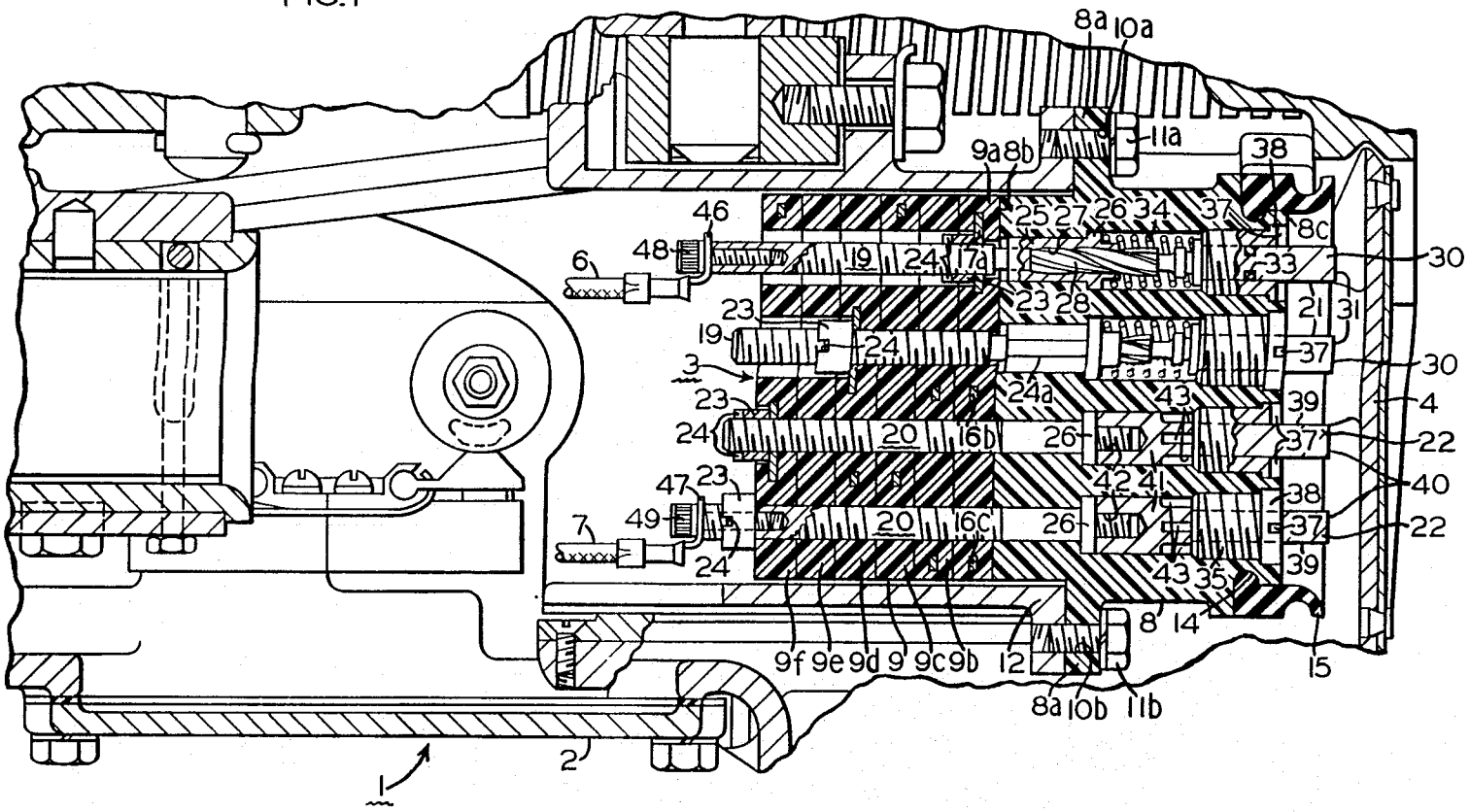
FIG. 1 is a side elevational view with portions broken away and partly in section of a multiple contact electrical portion for an automatic railway car coupler according to the present invention.

Referring now to the drawings, and in particular to FIG. 1 there is shown a multiple contact electrical train line circuit connection portion, generally characterized by numeral 1, for being suitably secured, such as, being bolted to the underside of an automatic railway car coupler (not shown).

The automatic car coupler, of which the electrical circuitry connecting portion 1 is a component, is illustrated and described in greater detail in U.S. Pat. No. 3,385,454, issued on May 28, 1968, to W. R. Jeffrey et al, entitled Automatic Air and Electric Railway Car Coupler and assigned to the assignee of the present application. It will suffice herein, therefore, to merely state that the automatic car coupler, as disclosed in the above-mentioned U.S. Pat., automatically effects mechanical coupling of two adjacent cars, connects the train air pipe lines, and effects connection of the multiple electrical train line circuits.

For such coupling, the mechanical couplers should be of a type capable of coupling or locking against substantial relative movement to a mating coupler and, ordinarily, the mechanical coupler will also mount air couplers to form a combined mechanical, air, and electric coupler for enabling both air and electric train lines to be coupled automatically as the vehicles are mechanically coupled. Such combined couplers are widely used on subway and commuter cars.

It will be understood herein that there is an electrical connection portion of the mating head (not shown) of another automatic car coupler (not shown) on which a connecting portion is also supported in suitable manner and position for contacting and engaging an oppositely-disposed connecting portion (not shown) of a counterpart mating head (not shown) of the car coupler. The electrical connection portion or connector 1 comprises an outer casing or housing 2 in which a slide multiple contact unit 3 is encased, and a movable front protective cover 4, which, in the uncoupled condition of the coupler is spring biased to a closed position for protecting the contact unit when not in use. A suitable operating member (not shown), when contacted by the counterpart mating head (not shown) during coupling operation, automatically effects operation of the cover 4, through a system of levers or the like (not shown), to an unobstructing open position in which the contact unit 3 is exposed for engaging the counterpart contact unit which is exposed simultaneously in similar fashion. Train wires, only two of which, 6 and 7, are shown in FIG. 1, making up the various electrical train line circuits, are brought into the electrical connection portion 1 through a suitable sealed conduit (not shown) located at the rear end of the electrical portion 1.

Figure 4:
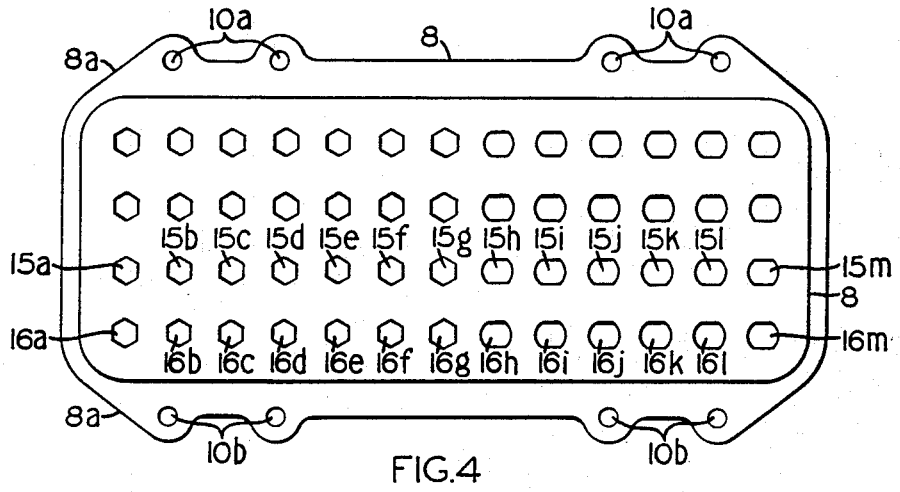
FIG. 4 is a rear elevational view of the insulative front block of FIG. 2.
Figure 3:
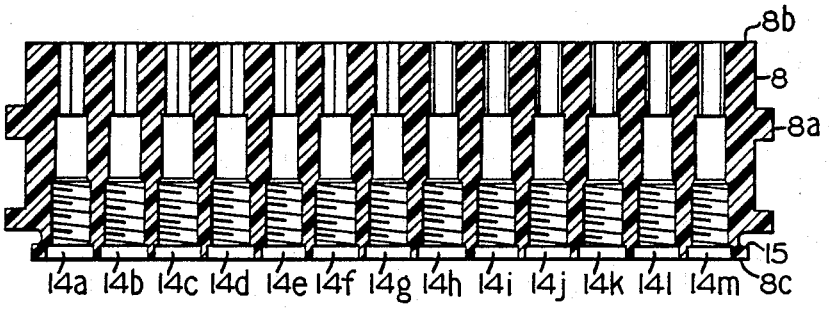
FIG. 3 is a cross-sectional view of the insulative front block taken along line III—III of FIG. 2.
Figure 2:
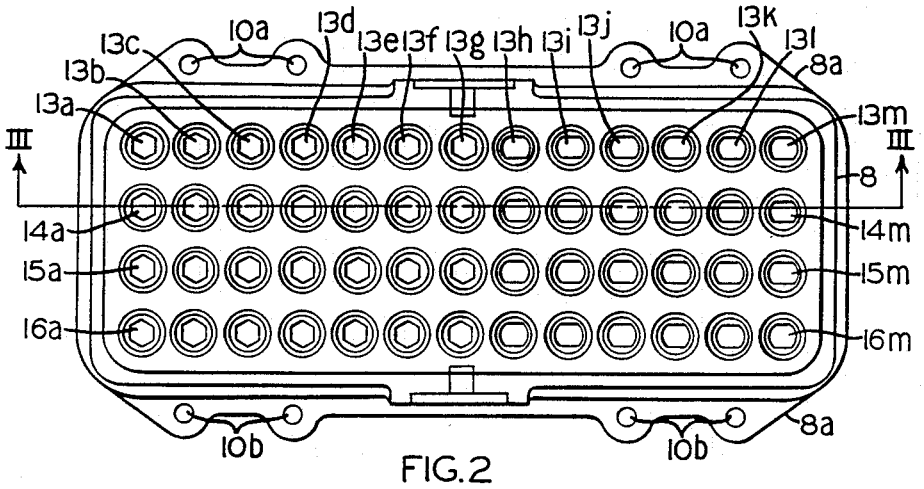
FIG. 2 is a reduced front elevational view of the insulative front block of the contact electrical portion shown in FIG. 1.

The multiple contact unit 3 includes a front insulator or insulative block 8 and a plurality or stack of rear insulative jumper plates 9*a*–9*f*. The insulative block 8 is molded of suitable thermoplastic material or the like. As shown in FIGS. 1, 2, and 4, the insulative, plastic block 8 includes a positioning and connecting flange 8*a* formed on the outside periphery. It will be appreciated that the peripheral flange member 8*a* may take the form of a metal collar, which is permanently molded to the insulative block 8 to satisfy the higher torque or strength requirements of certain end users. It will be seen that the upper and lower portions of the flange 8*a* include a plurality of apertured tabs 10*a* and 10*b*, which are fixedly secured by bolts 11*a* and 11*b* to the front face of the metal frame 12. As noted, a plurality of through holes or bores are formed in the insulative block 8. In the present embodiment, there are four (4) rows and thirteen (13) columns of through holes; however, it is understood that the number of rows and columns may be increased or decreased depending upon the needs of the customer and application.

In viewing FIGS. 1, 2, 3, and 4, it will be seen that the through holes 13*a–m*, 14*a–m*, 15*a–m* and 16*a–m* are graduated or have decreasing steps extending from the front side 8*c* to the back side 8*b* of the insulative block 8. The outer enlarged opening and the next threaded opening accommodate a slotted shoulder portion and a threaded portion of appropriate retaining nuts, as will be described hereinafter. As shown, an outer peripheral groove 14 is formed near the front face 8*c* of the insulative block 8 for accommodating a resilient weather gasket 15 to seal the electrical contacts from dirt, dust and moisture when in the coupled position.

In the present instance, the rear stack includes six (6) interchangeable insulative jumper plates 9*a*–9*f*. In viewing FIGS. 1, 5, and 6, it will be seen that the jumper plates also include four (4) rows and thirteen (13) columns of holes which are matched and aligned with the holes formed in the front block 8. Each of the insulative jumper plates includes encapsulated copper strips or ribbons, such as, intermediate conductive portions 16*a*, 16*b* and 16*c*. As shown, the intermediate portions of the elongated strips terminate or lead to eyelets or circular apertured portions 17*a*–17*f* which are physically exposed to be contacted by suitable brass jumper nuts that will be described presently.

During assemblage of the multiple contact unit, a series of threaded conductive studs 19 and 20 for movable and stationary contact elements 21 and 22 are initially inserted through the holes in the front insulative block 8 and into the corresponding aligned holes in the jumper plates 9a–9f. Next, the brass jumper nuts 23 are screw threaded onto the back ends of conductive studs 19 and 20. The internally threaded jumper nuts 23 are preferably made of brass and include four (4) ninety degree (90°) disposed slots 24 which may be securely tightened with a suitable deep socket spanner type wrench (not shown). When the jumper nuts 23 are completely tightened, they mechanically hold the stack of jumper plates 9a–9f firmly together to the front insulative block 8 and also electrically interconnect the jumper strips with the respective conductive studs 19 and 20. It will be observed that the studs 19 and 20 include intermediate shoulder portions 24a and 25 which fit into the rearmost portions of the through holes formed by the insulative block 8. It will be seen that these portions have different cross-sectional forms. The cross-section of shoulder portion 24a of studs 19 is hexagonally shaped while the cross-section of the shoulder portion 25 of studs 20 is barrel shaped so that the studs may not be inadvertently interchanged. Further, each of the studs includes an annular flange 26 which rests against the rear wall of next to the rearmost portion of the through holes of the insulative block 8. As shown in FIGS. 1 and 11, the innermost ends of studs 19 include a flutted female opening 27 while the innermost ends of studs 20 include a reduced screw thread 20b.

As shown in FIGS. 1 and 12, the movable contact elements 21 include a rear flutted male portion 28 and an intermediate collar 29 and a front elongated stem 30 having a flat front face 31. An annular groove 32 is formed in the intermediate portion of the stem portion 30 for receiving a resilient sealing O-ring 33. Initially, a return compression spring 34 is placed about the flutted portion 28, and then the male flutted portion 28 is guided into the female flutted portion 27. Thus, the biasing return spring is caged between the annular flange 26 and the intermediate collar 29. Next, an externally threaded retaining nut 35 having a through hole 36 is slipped onto contact stem portion 30. A spanner-like socket wrench (not shown) is then inserted into radial extending slots 37, and then the nut is tightened until the shoulder 38 is seated against the inner wall of the enlarged outer opening formed in the insulative block 8. It will be noted that the O-ring 33 provides an effective seal to prevent the entry of dirt, dust and moisture.

In view of FIGS. 1 and 8, it will be noted that each of the stationary contact elements 22 includes a contact stem 39 having a flat front face 40 and an enlarged rear portion 41. The rear portion 41 includes a threaded hole 42 and four (4) ninety degree (90°) disposed radial slots 43. The stationary contact elements 22 are inserted into the appropriate holes in the insulative block 8. A suitable deep socket spanning like wrench (not shown) is inserted into slots 43 and the contact elements 22 are tightened until the bottom of the portion (4) engages collars 26. Then, an apertured retainer nut 35 is slipped over stem 39 and is tightened by the spanner wrench until the shoulder 38 is seated against the inner wall of the enlarged outer opening of the insulative block 8.

As noted above, all of the contact elements 21 and 22 preferably have substantially flat front ends 31 and 40 for abutting engagement with the contacts of a mating coupler. During coupling, the movable contact elements 21 are engaged and depressed by mating contacts. As the movable contact elements are depressed, they are also rotated by the flutes so that a wiping action occurs which cleans the contact surfaces and improves the electrical interconnections. As shown in FIG. 1, the conductive leads 6 and 7 are securely attached to the studs 19, 20 by eyelet terminals 46 and 47 and appropriate screws 48 and 49.

It would be appreciated that the jumper wire configuration may be suitably selected and readily changed for each particular application by interchanging the jumper plates. In addition, the movable and stationary contact elements 21 and 22 are easily removed from the front of the insulative block 8 so that damaged or worn elements may be readily replaced with a minimum disruption and within a minimal amount of time.

Thus, the present invention has been described in such full, clear, concise and exact terms as to enable any person skilled in the art to which it pertains to make and use the same, and having set forth the best mode contemplated of carrying out this invention. I state that the subject matter, which I regard as being my invention, is particularly pointed out and distinctly asserted in what is claimed. It will be understood that variations, modifications, equivalents and substitutions for components of the above specifically-described embodiment of the invention may be made by those skilled in the art without departing from the spirit and scope of the invention as set forth in the appended claims.

I claim:

1. An electrical connector portion for an automatic railway car coupler comprising, a slide frame connectable to the electrical connector portion, a multiple contact unit carried by said slide frame, said multiple contact unit includes an outer insulative block having a plurality of aligned apertures for accommodating a plurality of movable and stationary contact elements and including an inner insulative block constructed of a plurality of stacked jumper plates, each of said jumper plates having a plurality of aligned holes for accommodating a plurality of conductive studs which are electrically connected to the respective movable and stationary contact elements and, in turn, which are electrically connected to selected train line conductors.

2. The electrical connector portion for an automatic railway car coupler, as defined in claim 1, wherein said movable contact elements are biased outwardly by a compression spring and are held within the respective aperture by a threaded retaining nut.

3. The electrical connector portion for an automatic railway car coupler, as defined in claim 2, wherein each of said movable contact elements includes an annular groove for accommodating an O-ring which seals against the aperture of retaining nut to prevent entry of contaminants.

4. The electrical connector portion for an automatic railway car coupler, as defined in claim 2, wherein each of said movable contact elements includes a fluted portion for converting linear movement to rotary motion.

5. The electrical connector portion for an automatic railway car coupler, as defined in claim 1, wherein each of said stacked jumper plates includes at least one copper strip for selectively interconnecting said conductive studs.

6. The electrical connector portion for an automatic railway car coupler, as defined in claim 5, wherein said conductive studs include inner threaded portions for receiving binding nuts which engage said copper strips.

7. The electrical connector portion for an automatic railway car coupler, as defined in claim 1, wherein each of said stationary contact elements includes a threaded female portion which is screwed onto a threaded male portion formed on each of the respective associated conductive studs.

8. The electrical connector portion for an automatic railway car coupler, as defined in claim 5, wherein said copper strips are embedded in said jumper plates.

9. The electrical connector portion for an automatic railway car coupler, as defined in claim 8, wherein each of said copper strips includes an intermediate connection portion and terminal eyelet portions.

10. The electrical connector portion for an automatic railway car coupler, as defined in claim 2, wherein said threaded retaining nuts include a slotted head for permitting frontal removal and replacement of said movable and stationary contact elements.

11. The electrical connector portion for an automatic railway car coupler, as defined in claim 10, wherein each of said stationary contact elements includes an outer cylindrical stem portion and an inner slotted enlarged portion for receiving a deep socket wrench.

12. The electrical connector portion for an automatic railway car coupler, as defined in claim 6, wherein said binding nuts include a slotted head for accepting a deep socket wrench.

13. The electrical connector portion for an automatic railway car coupler, as defined in claim 1, wherein each of the conductive studs of the respective movable and stationary contact elements includes a non-circular portion which fits into corresponding holes formed in said outer insulative block.

14. The electrical connector portion for an automatic railway car coupler, as defined in claim 13, wherein said non-circular portion of said conductive studs of said movable contact elements takes the for of a hexagon section.

15. The electrical connector portion for an automatic railway car coupler, as defined in claim 13, wherein said non-circular portion of said conductive studs of said stationary contact elements takes the form of a barrel section.

16. An electrical connector portion for an automatic railway car coupler comprising, a multiple contact unit, said multiple contact unit includes an outer insulative block having a plurality of aligned apertures for accommodating a plurality of movable and stationary contact elements, and includes an inner insulative block having a plurality of stacked jumper plates, each of said jumper plates having a plurality of aligned holes for accommodating a plurality of conductive studs which are electrically connected to the respective movable and stationary contact elements and, in turn, which are electrically connected to selected train line conductors.

17. An electrical connector portion for an automatic railway car coupler comprising, a mounting frame for supporting the electrical connector portion, a multiple contact unit carried by said mounting frame, said multiple contact unit includes a front insulative block having a plurality of aligned apertures for accommodating a plurality of movable and stationary contact elements and includes a stack of rear insulative jumper plates, each of said jumper plates having a plurality of aligned holes for accommodating a plurality of conductive studs which are electrically connected to the respective movable and stationary contact elements which, in turn, are electrically connected to selected train line conductors.

18. The electrical connector portion for an automatic railway car coupler, as defined in claim 17, wherein said movable contact elements are biased outwardly by a compression spring and are held within the respective aperture by threaded retaining nut.

19. The electrical connector portion for an automatic railway car coupler, as defined in claim 18, wherein each of said movable contact elements includes an annular groove for accommodating an O-ring which seals against the aperture of the retaining nut to prevent entry of contaminants.

20. The electrical connector portion for an automatic railway car coupler, as defined in claim 18, wherein each of said movable contact elements includes a fluted portion for converting linear movement to rotary motion.

* * * * *